US005475192A

United States Patent [19]

Inagaki et al.

[11] Patent Number: 5,475,192

[45] Date of Patent: Dec. 12, 1995

[54] KEYTOP SHEET FOR PUSH-BUTTON SWITCHES

[75] Inventors: Jiro Inagaki, Tokyo; Atsushi Hari; Nobuyuki Kikuchi, both of Kanagawa; Takashi Shinoki, Tokyo, all of Japan

[73] Assignee: Teikoku Tsushin Kogyo Co., Ltd., Kanagawa, Japan

[21] Appl. No.: 138,065

[22] Filed: Oct. 20, 1993

[30] Foreign Application Priority Data

Mar. 15, 1993 [JP] Japan ..... 5-080049
Mar. 16, 1993 [JP] Japan ..... 5-081366

[51] Int. Cl.[6] ..... H01H 3/12

[52] U.S. Cl. ..... 200/341; 200/520; 200/512; 200/513

[58] Field of Search ..... 200/341, 520, 200/512, 517, 513, 516, 5 A; 29/622

[56] References Cited

U.S. PATENT DOCUMENTS 4,814,561 3/1989 Kawasaki ..... 200/517
4,839,474 6/1989 Hayes-Pankhurst et al. ..... 200/5 A

FOREIGN PATENT DOCUMENTS

0483898A2 5/1992 European Pat. Off. .
2219691 12/1989 United Kingdom ..... 200/512

*Primary Examiner*—Henry J. Recla
*Assistant Examiner*—David J. Walczak
*Attorney, Agent, or Firm*—Wenderoth, Lind & Ponack

[57] ABSTRACT

A keytop sheet of a push-button switch includes a keytop, which is made of synthetic resin, molded on a sheet of resin film. A portion of the film sheet surrounding the portion thereof on which the keytop is molded is provided with a curved projection protruding in a downward and/or upward direction from the surface of the film sheet. Alternatively, a cut-out separates the portion of the film sheet on which the keytop is molded from the remainder of the film sheet while leaving a hinge portion, and a nameplate through which the keytop passes is attached to the film sheet so as to over the cut-out and hinge portion of the film sheet. The nameplate may have an outer diameter greater than that of the film sheet, and a frame made of synthetic resin is fixed to an underside of the film sheet on an outer peripheral portion thereof. The outer peripheral portion of the nameplate is bent and fixed to an outer peripheral side surface of the frame.

2 Claims, 18 Drawing Sheets

A
L
L+ΔL
220
210
230
ΔL
0.1 mm
0.05 mm
A°
ΔL
25°
20°
15°
10°
5°
0.5 1.0 1.5 2.0 2.5 3.0 3.5 4.0 4.5 5.0 5.5 6.0 6.5 7.0
( mm )
L

KEYTOP SHEET FOR PUSH-BUTTON SWITCHES

BACKGROUND OF THE INVENTION

This invention relates to a compact keytop sheet for push-button switches suited for integration. The invention further relates to a method of manufacturing the keytop sheet.

The reduction in the size and thickness of electronic devices that has been achieved in recent years has been accompanied by a demand to reduce the size and thickness also of the keytop sheet for the push-button switches used on the control panels of these devices.

In an effort to meet this demand, a keytop sheet has been proposed in which a plurality of keytops made of synthetic resin are fixedly molded to a film sheet comprising a single film made of resin, and a frame made of synthetic resin is fixedly molded to the periphery of the film sheet so as to encircle the plurality of keytops.

A switch contact is disposed below each keytop so that if the keytop is pressed, the switch underlying it will be closed. At such time the film sheet surrounding the keytop is tensioned slightly in the downward direction.

These push-button switches using a keytop sheet of this kind include some that are used in environments in which there is the danger of humidity and moisture penetrating the interior of the switch. In such a case, there are instances in which it is preferred that the keytop sheet have a so-called waterproof structure in which humidity and moisture will not penetrate the underside of the sheet from the top side thereof. To achieve this, it is required that the film sheet be entirely devoid of holes.

When the conventional keytop sheet is such that the spacing between the keytops and the frame or the spacing between the keytops themselves is reduced for the sake of miniaturization, the following problems arise.

Specifically, FIG. 20 is a diagram showing the relationship among an angle of inclination A of a film sheet 210, L and ΔL, where L represents the spacing between a keytop 220 and a frame 230 to which a film sheet 210 has been affixed, and ΔL represents the amount by which the film sheet 210 must stretch when the keytop 220 is depressed by 0.3 mm.

As indicated by the graph of FIG. 20, the smaller the spacing L, the much greater the amount of stretch ΔL and the angle of inclination A. In other words, the smaller the spacing L is made, the more difficult it is to depress the keytop 220. If the keytop 220 is pressed too strongly in such case, there is the danger that the film sheet 210 will be deformed.

Further, when any single keytop is pressed, a keytop alongside it is pulled slightly toward the pressed keytop. However, when the spacing between mutually adjacent keytops is made small, the amount of pull becomes much larger by reason of a principle similar to that described above in connection with FIG. 20. Consequently, when one keytop is pressed, there is the danger that the keytop alongside will be moved toward the pressed keytop to a noticeable extent.

If it is unnecessary to provide the keytop sheet itself with a waterproof function, then it will suffice to provide the portion of the film sheet surrounding each keytop with a C-shaped cut-out in order to solve the above-mentioned problem. If such an arrangement is adopted, the film sheet surrounding a keytop will not be pulled when the keytop is pressed, thereby facilitating operation of the keytop. However, when the film sheet is provided with a cut-out, the cut-out is visible from above the keytop sheet and detracts from the appearance of the device.

SUMMARY OF THE INVENTION

Accordingly, an object of the present invention is to provide a keytop sheet of a push-button switch having a simple structure in which each keytop can be pressed smoothly even if the keytop sheet is miniaturized.

Another object of the present invention is to provide a keytop sheet of a push-button switch in which the keytop sheet itself can readily be provided with a waterproof structure as necessary.

A further object of the present invention is to provide a keytop sheet in which an attractive external appearance is maintained even if the film sheet is provided with a cut-out.

According to the present invention, there is provided a keytop sheet of a push-button switch in which a keytop, to be arranged above a switch contact and having an underside provided with a pushing portion for opening and closing the switch contact by pressing it, is molded at a prescribed position on a film sheet comprising a resin film, and characterized in that a portion of the film sheet surrounding the portion thereof on which the keytop is molded is provided with a curved projection, which protrudes in a downward and/or upward direction from the surface of the film sheet, so as encircle the keytop.

When the keytop is pressed to, the curved projection provided in the film sheet about the keytop is deformed, thereby making it easier to press the keytop.

According to the present invention, there is also provided a keytop sheet of a push-button switch in which a keytop, to be arranged above a switch contact and having an underside provided with a pushing portion for opening and closing the switch contact by pressing it, is molded at a prescribed position on a film sheet comprising a resin film, and characterized in that a portion of the film sheet surrounding the portion thereof on which the keytop is molded is provided with a cut-out leaving a hinge portion, and a nameplate comprising a resin film and provided with a hole shaped so that the keytop passes therethrough is attached to the film sheet so as to cover the cut-out and hinge portion of the film sheet.

In this invention, the keytop is connected to the surrounding film sheet solely by the hinge portion, as a result of which the keytop can be pressed smoothly. Moreover, since the cut-out in the film sheet is covered by the nameplate, the cut-out cannot be seen from the surface and an attractive appearance is maintained as a result. Further, although the hinge portion develops a wrinkle when the keytop is pressed, the hinge portion is covered by the nameplate so that the attractive appearance of the keytop sheet is maintained in this sense as well.

According to the present invention, there is still further provided a keytop sheet of a push-button switch comprising a film sheet on a prescribed position of which is molded a keytop, to be arranged above a switch contact and having an underside provided with a pushing portion for opening and closing the switch contact by pressing it, a nameplate mounted on the film sheet and comprising a resin film having an outer diameter greater than that of the film sheet, and a frame made of synthetic resin molded on an underside of the film sheet on a peripheral portion thereof so as to be affixed to the film sheet, an outer peripheral portion of the nameplate that protrudes beyond the film sheet being bent and fixed to an outer peripheral side surface of the frame.

Since the outer peripheral portion of the nameplate is thus fixed to the outer peripheral side surface of the frame upon being bent, the upper edge portion on the outer periphery of the keytop sheet is covered by the nameplate. Therefore, even if the upper edge portion on the outer periphery of the keytop sheet protrudes somewhat from the surface of the case accommodating the keytop sheet, an attractive appearance in terms of design is maintained. Further, since the nameplate completely covers the film sheet and even extends up to the side face of the frame, the nameplate will peel off the film sheet only with great difficulty.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 2(A) and 2(B) are diagrams illustrating the keytop sheet of the switch shown in FIG. 1, in which FIG. 2(A) is a plan view and FIG. 2(B) a side view of the keytop sheet;

FIGS. 3(A) and 3(B) are diagrams illustrating a film sheet of the keytop sheet shown in FIGS. 2(A) and 2(B), in which FIG. 3(A) is a plan view and FIG. 3(B) a side view of the film sheet;

FIGS. 6(A) and 6(B) are diagrams illustrating a third embodiment of a keytop sheet according to the present invention, in which FIG. 6(A) is a sectional view taken along line 6(A)—6(A) of FIG. 6(B), and FIG. 6(B) a plan view of a principal portion of the keytop sheet;

FIGS. 7(A), 7(B), 7(C) and 7(D) are diagrams illustrating a fourth embodiment of a keytop sheet according to the present invention, in which FIG. 7(A) is a plan view of a principal portion of the keytop sheet, FIG. 7(B) a sectional view taken along line 7(B)—7(B) of FIG. 7(A), FIG. 7(C) is a bottom view, and FIG. 7(D) is a plan view of a film sheet used in the keytop sheet of this embodiment;

FIGS. 8(A), 8(B) and 8(C) are diagrams illustrating a fifth embodiment of a keytop sheet according to the present invention, in which FIG. 8(A) is a plan view, FIG. 8(B) a sectional view taken along line 8(B)—8(B) of FIG. 8(A), and FIG. 8(C) is a bottom view;

FIGS. 11(A) and 11(B) are diagrams illustrating the keytop sheet of FIG. 10, in which FIG. 11(A) is a plan view and FIG. 11(B) is a side view;

FIG. 19(B) is a schematic view of the principal portion showing the state in which a push-button switch is accommodated in a case;

DESCRIPTION OF THE PREFERRED EMBODIMENTS

Preferred embodiments of the present invention will now be described in detail with reference to the accompanying drawings.

Figure 1:
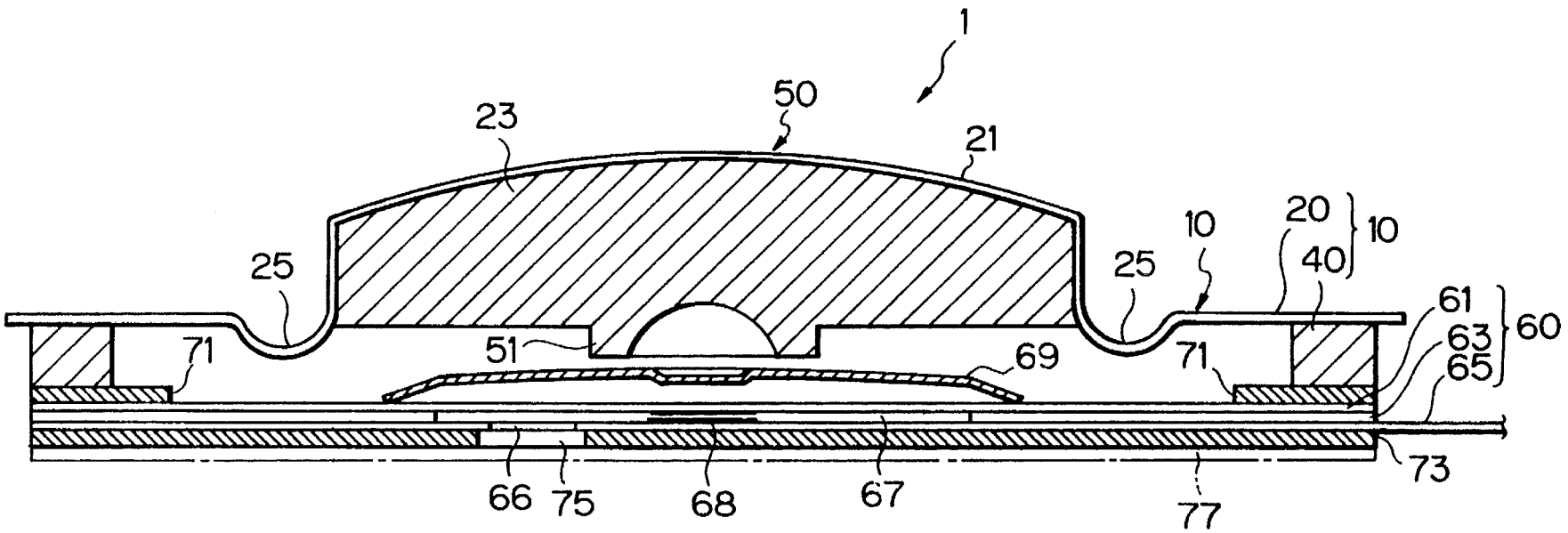
FIG. 1 is a sectional view of a push-button switch one component of which is a first embodiment of a keytop sheet according to the present invention.

FIG. 1 is a sectional view of a push-button switch, one component of which is a first embodiment of a keytop sheet according to the present invention. As shown in FIG. 1, a push-button switch 1 includes a switch substrate 60 formed by superimposing an upper sheet 61, a spacer 63 and a lower sheet 65, and a keytop sheet 10 obtained by fixing a frame 40 to the outer periphery of the underside of a film sheet 20 provided with a keytop 50. A click spring 69 is attached to the switch substrate 60 over a switch contact 68, and the frame 40 of the keytop sheet 10 is affixed to the outer periphery of the switch substrate 60 via a sheet 71 having an adhesive on both sides thereof.

Figure 2A:
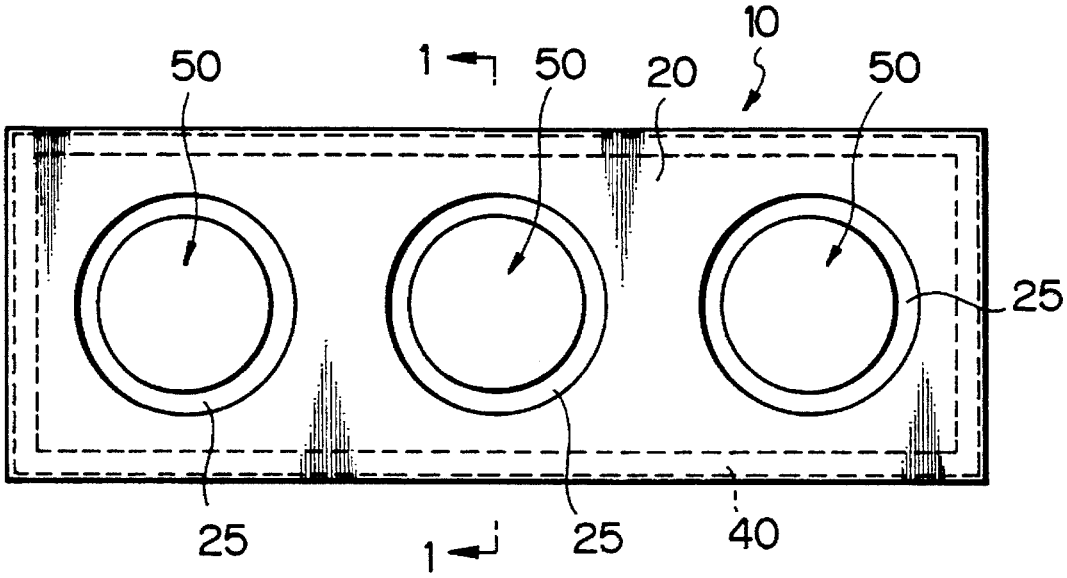
Figure 2B:
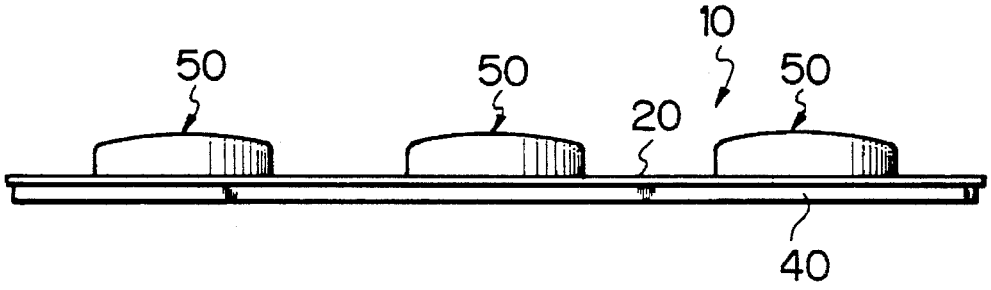

FIGS. 2(A) and 2(B) are diagrams illustrating the keytop sheet 10, in which FIG. 2(A) is a plan view and FIG. 2(B) a side view. It should be noted that the keytop sheet 10 in FIG. 1 is a sectional view taken along line 1—1 in FIG. 2(A).

As shown in FIGS. 1 and FIGS. 2(A), 2(B), the keytop sheet 10 has three keytops 50 provided on the central portion of the film sheet 20, and the frame 40 is attached to the underside of the film sheet 20 along the outer periphery thereof. Further, the portions of the film sheet 20 surrounding the portions thereof to which the keytops 50 are curved projections 25, each of which protrudes in a downward direction from the surface of the film sheet 20, so as surround the respective keytops 50.

Figure 3A:
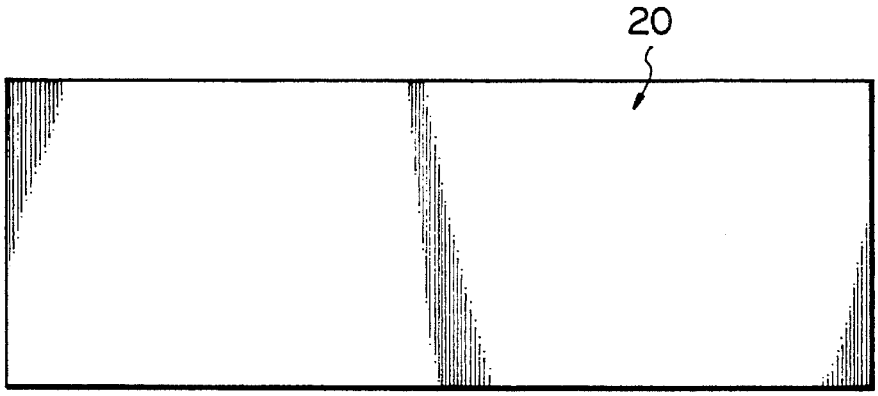
Figure 3B:
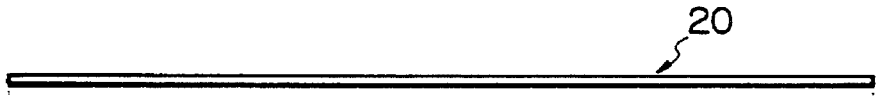

In order to manufacture the keytop sheet 10, first the film sheet 20 is prepared. As shown in FIGS. 3(A) and 3(B), the film sheet 20 is manufactured by cutting a thermoplastic synthetic-resin film (e.g., polyethylene terephthalate, polyethylene naphthalate, etc.) into a rectangular shape and printing a desired design (not shown) on the top or underside of the sheet.

Figure 4:
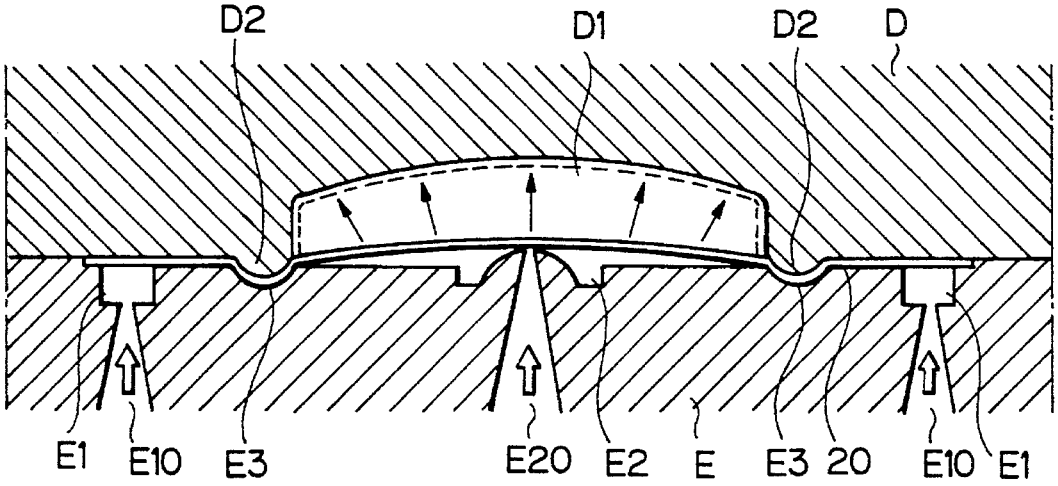
FIG. 4 is a diagram illustrating a method of forming the keytop sheet of the switch shown in FIG. 1 by resin molding.

Next, as illustrated in FIG. 4, the film sheet 20 is clamped between an upper mold D and a lower mold E. The upper mold D is provided with a cavity D1 for forming the keytop 50, and the lower mold E is provided with a cavity E1 for forming the frame 40 and a cavity E2 for forming the pushing portion 51 of the keytop 50. Further, the cavities E1, E2 of the lower mold E are provided with pin gates E10, E20, respectively.

The portion of the upper mold D surrounding the cavity D1 is provided with a ring-shaped projection D2. The latter has a semicircular cross section.

The lower mold E is provided with a ring-shaped cavity E3 at a position opposing the projection D2. The cavity E3 has a semicircular cross section and is formed to have such dimensions that a gap equivalent to the thickness of the film sheet 20 will be defined between the lower mold E and the projection D2 when the upper mold D and lower mold E are closed.

When a molten resin under conditions of high temperature and pressure is forcibly introduced from the pin gates E10, E20, the frame 40 is formed on the outer peripheral portion on the underside of the film sheet 20, and the portion of the film sheet 20 situated in the cavity D1 is urged upward and deformed so as to adhere to the inner surface of the mold D, as indicated by the dashed line in FIG. 4. At the same time, the cavity D1 and the cavity E2 are filled with the molten resin. In other words, the film sheet 20 is formed to include a bulge 21 (see FIG. 1) having the shape of the inner surface of the mold D defining cavity D1, and the bulge 21 is filled with charged resin 23 (see FIG. 1) that is allowed to harden to unify the film sheet 20 and the resin 23, thereby forming the keytop 50.

Since the molten resin introduced at this time is at a high temperature and pressure and the film sheet 20 consists of thermoplastic resin, the forcibly introduced resin and film sheet 20 are directly and strongly fused together and the film sheet 20 will not peel off.

The portion of the film sheet 20 clamped between the projection D2 and the MOLD E shown in FIG. 4 is thermoplastically deformed into the clamped shape by the heat of the introduced molten resin and the heat from the upper and lower molds D, E themselves. As a result, the curved projection 25 is formed in the film sheet 20.

As an alternative to forming the curved projection 25 in the film sheet 20 by the upper and lower molds D, E, the film sheet may be furnished with the curved projection 25 in advance by a forming process, after which the film sheet may be clamped between the upper and lower molds D, E.

Separating the upper and lower molds D, E completes the formation of the keytop sheet 10 shown in FIG. 1 and FIGS. 2(A), (B).

As shown in FIG. 1, the switch substrate 60 is an ordinary membrane switch and is produced by superimposing the upper and lower sheets 61, 65 with the spacer 63 sandwiched between them. The spacer 63 is provided with a hole 67 within which electrode patterns formed on respective ones of the upper and lower sheets 61, 65 are arranged in opposition to each other so as to construct the switch contact 68. The lower sheet 65 is provided with an air-venting hole 66.

The click spring 69, which is made of metal or resin, is attached over the switch contact 68.

Sheets 71, 73 both sides of each of which are provided with an adhesive are affixed to the upper and lower surfaces, respectively, of the switch substrate 60. The double-sided adhesive sheet 71 on the upper side is affixed so as to surround the entire outer periphery of the top side of the switch substrate 60, and the double-sided adhesive sheet 73 on the lower side covers the entire underside of the switch substrate 60 and is affixed in such a manner that the air-venting hole 75 is situated at a prescribed position relative to the switch substrate 60. It should be noted that a separator 77 is affixed to the underside of the lower double-sided adhesive sheet 73.

Bonding the upper double-sided adhesive sheet 71 to the underside of the frame 40 of the keytop sheet 10 completes the push-button switch 1.

When the push-button switch 1 is secured to another member, it will suffice to peel the separator 77 off and affix the underside of the doubled-sided adhesive sheet to the other member.

When the keytop 50 of the keytop sheet 10 is pressed, the pushing portion 51 presses the click spring 69, which snaps back to produce a clicking sensation, as well as the switch contact 68 to close the same.

Since the film sheet 20 is provided with the curved projection 25, the curved projection 25 is deformed when the keytop 50 is pressed to lower the keytop 50, as a result of which the pressing operation is facilitated. The reason for this is that when the keytop 50 is pressed, the stretching of the film by an amount equivalent to the stroke of the keytop 50 is compensated for (absorbed) by the shape deformation of the curved projection 25.

Further, since the film sheet 20 of the keytop sheet 10 is not provided with any holes, water cannot penetrate the push-button switch 1 to the underside of the film sheet 20 even if the switch is exposed to water from above.

In the embodiment described above, the keytop 50 can be brightly illuminated from its lower side if the resin 23 consists of a transparent material and a light-emitting element is disposed at a prescribed position below the keytop 50.

Further, in the embodiment described above, a membrane switch comprising a flexible substrate is used as the switch substrate 60. However, it is permissible to use switch substrates of other types, such as a rigid substrate.

Although the frame 40 is provided on the periphery of the underside of film sheet 20 so as to surround the keytop 50, it is not always necessary for the keytop sheet in this invention to have the frame 40. More specifically, a keytop sheet devoid of a frame may be arranged directly on a switch substrate, or a keytop sheet devoid of a frame may be retained by another member and this member may be arranged on the switch substrate.

Further, in the first embodiment described above, there are instances in which the adhesion between the film sheet 20 and keytop 50 is weak depending upon the quality and thickness of the film sheet 20 or the quality and melting temperature of the molding resin used to form the keytop 50 and the frame 40. In such a case, the union between the film sheet and keytop can be strengthened if an adhesive layer is interposed between them.

Figure 5:
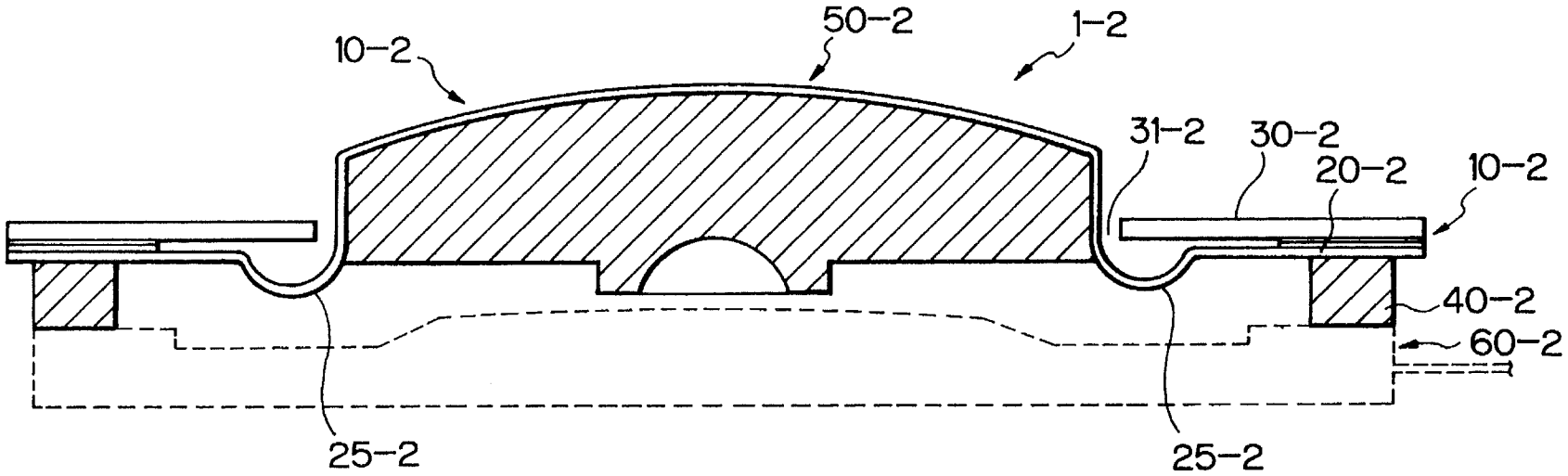
FIG. 5 is a schematic sectional view of a push-button switch one component of which is a second embodiment of a keytop sheet according to the present invention.

FIG. 5 is a sectional view illustrating a push-button switch 1-2 one component of which is a second embodiment of a keytop sheet 10-2 according to the present invention. Since a switch substrate 60-2 is identical to the switch substrate 60 of the first embodiment, the outline of the switch substrate 60-2 is indicated by the dashed line in FIG. 5.

This embodiment differs from the first embodiment in that a nameplate 30-2 is affixed to the upper side of a film sheet 20-2. The nameplate 30-2 is provided with a circular hole 31-2 through which a keytop 50-2 is passed. More specifically, the nameplate 30-2 is affixed to the film sheet 20-2 in such a manner that the keytop 50-2 passes through the hole 31-2.

If this arrangement is adopted, a curved projection 25-2 provided on the film sheet 20-2 will no longer be visible to the eye. In addition, the top side or underside of the nameplate 30-2 can be printed in a variety of ways.

Figure 6:
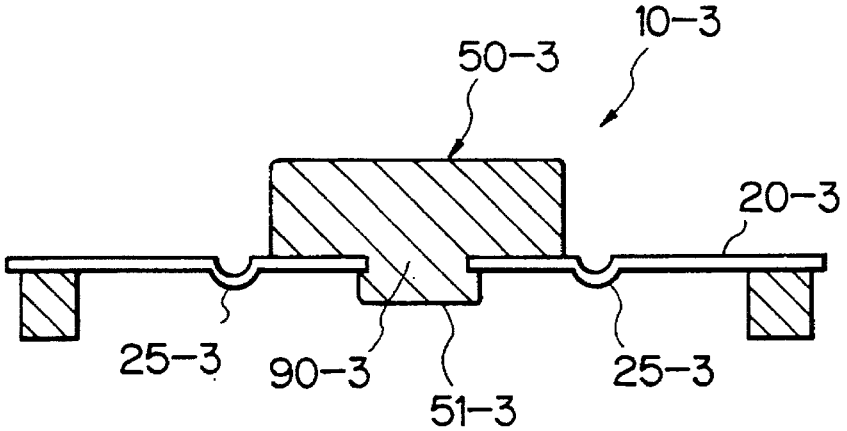
Figure 6:
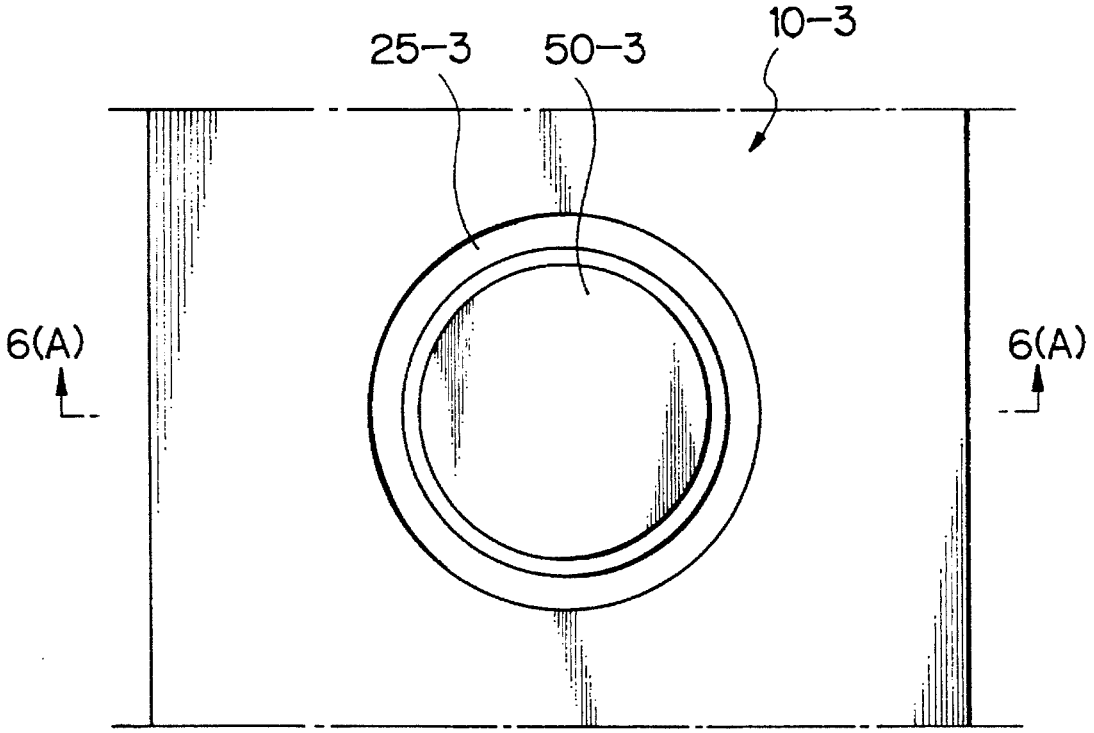

FIGS. 6(A) and 6(B) are diagrams illustrating a third embodiment of a keytop sheet 10-3 according to the present invention, in which FIG. 6(A) is a sectional view taken along line 6(A)—6(A) of FIG. 6(B), and FIG. 6(B) is a plan view of a principal portion.

The keytop sheet 10-3 shown in FIGS. 6(A), 6(B) includes a film sheet 20-3 provided with a hole 90-3, and a keytop 50-3 molded by charging molten resin above and below the film sheet 20-3 via the hole 90-3. In this embodiment, a pushing portion 51-3 of the keytop 50-3 is situated on the underside of the keytop 50-3 at the central portion thereof, just as in the first and second embodiments. Further, a curved projection 25-3 is provided surrounding the keytop 50-3.

Figure 7:
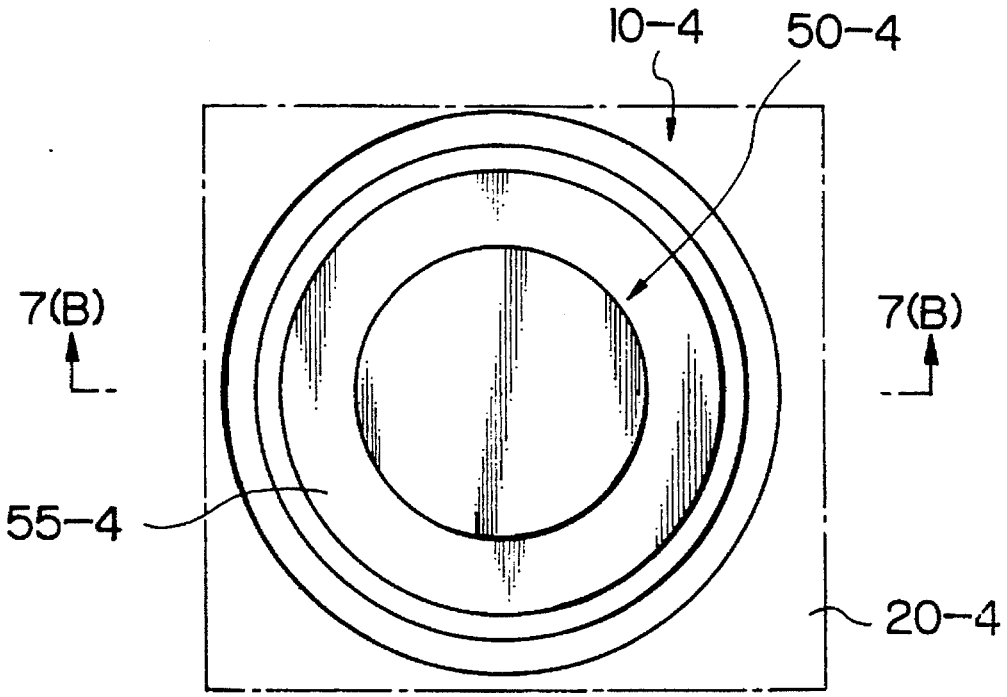
Figure 7:
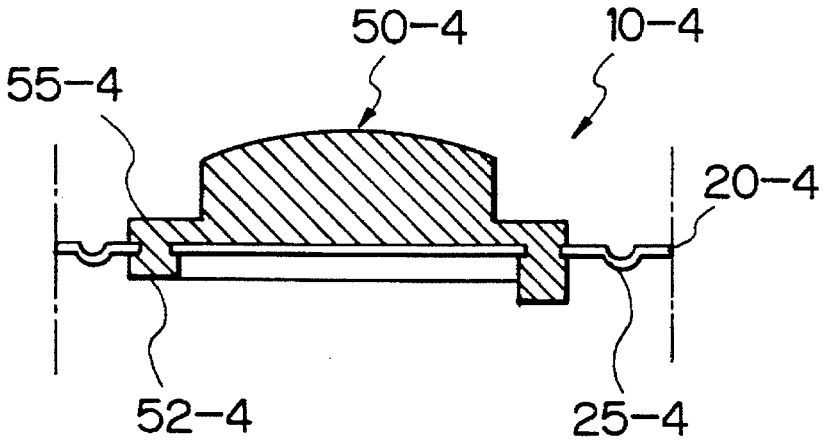
Figure 7:
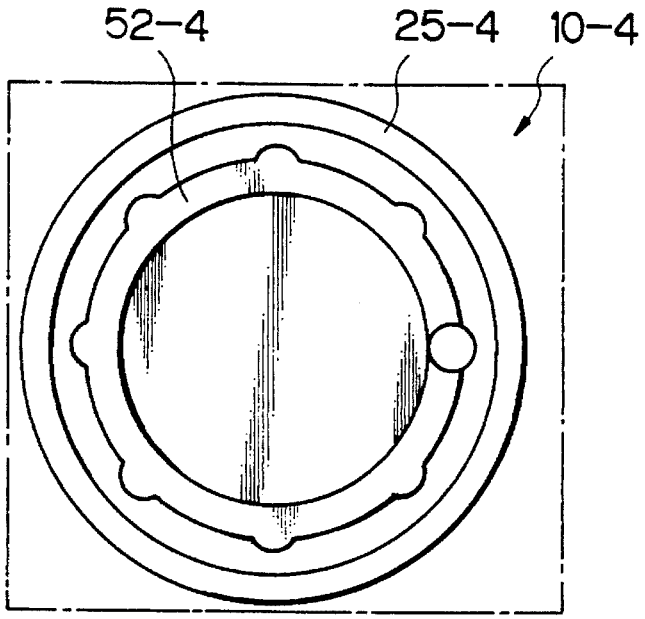
Figure 7:
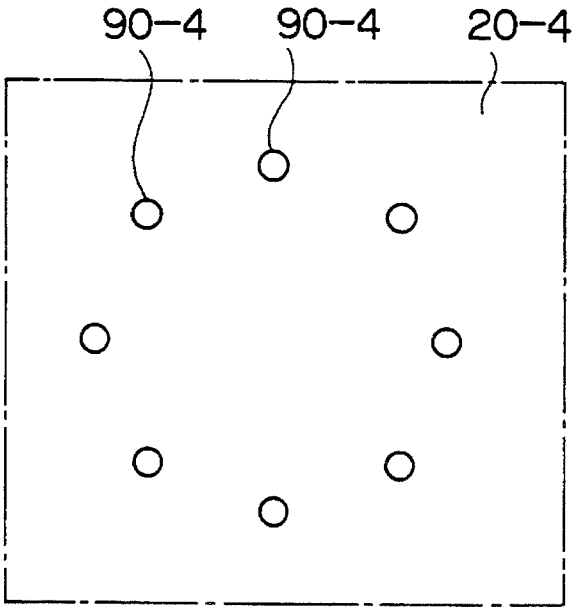

FIGS. 7(A), 7(B) and 7(C) are diagrams illustrating a fourth embodiment of a keytop sheet 10-4 according to the present invention, in which FIG. 7(A) is a plan view, FIG. 7(B) a sectional view taken along line 7(B)—7(B) of FIG. 7 (A) and FIG. 7(C) is a bottom view. FIG. 7(D) is a plan view of a film sheet 20-4 used in the keytop sheet 10-4 of this embodiment.

In the case of the keytop sheet 10-4 according to this embodiment, a film sheet 20-4 is provided with eight holes 90-4 in a ring-shaped configuration, as shown in FIG. 7(D), and a keytop 50-4 is molded by charging molten resin above and below the film sheet 20-4 via the holes 90-4. According to this embodiment, the film sheet 20-4 is clamped and secured by a film fixing portion 55-4 molded at the outer periphery of the top of keytop 50-4 and a ring-shaped film retaining portion 52-4 molded on the underside of the film sheet 20-4. The periphery of the keytop 50-4 is surrounded by a curved projection 25-4.

Figure 8:
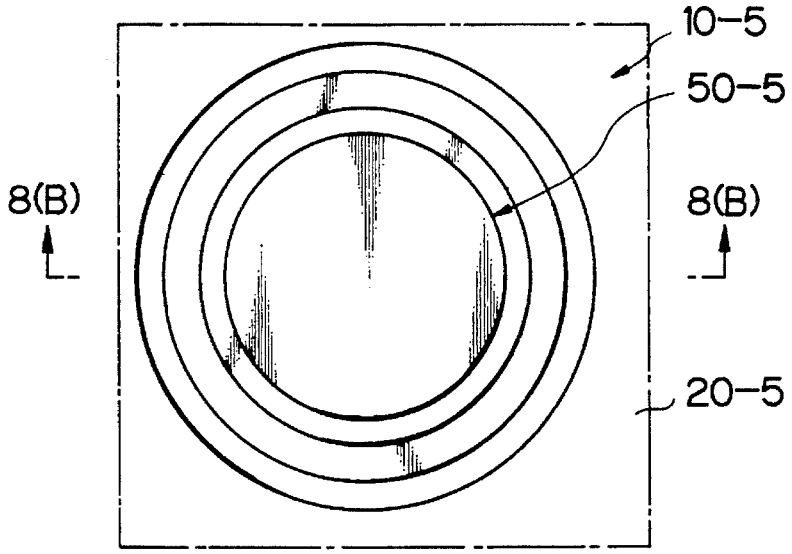
Figure 8:
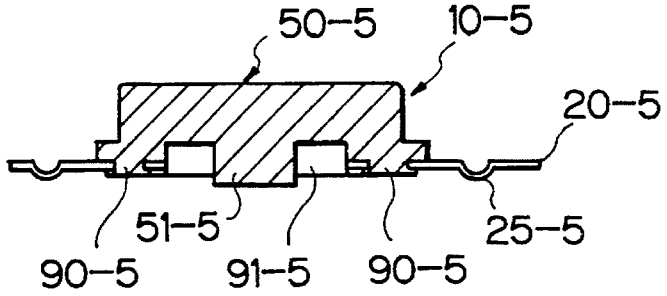
Figure 8:
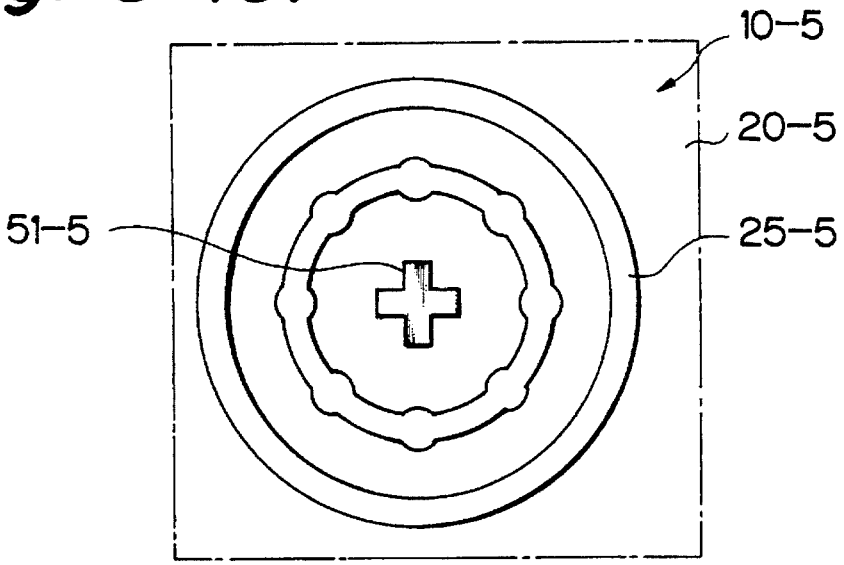

FIGS. 8(A), 8(B) and 8(C) are diagrams illustrating a fifth embodiment of a keytop sheet 10-5 according to the present invention, in which FIG. 8(A) is a plan view, FIG. 8(B) a side sectional view taken along line 8(B)—8(B) of FIG. 8(A) and FIG. 8(C) is a bottom view.

In the case of the keytop sheet 10-5 according to this embodiment, a film sheet 20-5 is provided with holes 90-5 in a ring-shaped configuration in a manner similar to that shown in FIG. 7(D), a large hole 91-5 is provided at the center of the ring, and a keytop 50-5 is molded by charging molten resin above and below the film sheet 20-5 via the holes 90-5, 91-5. The periphery of the keytop 50-5 is surrounded by a curved projection 25-5.

Figure 9:
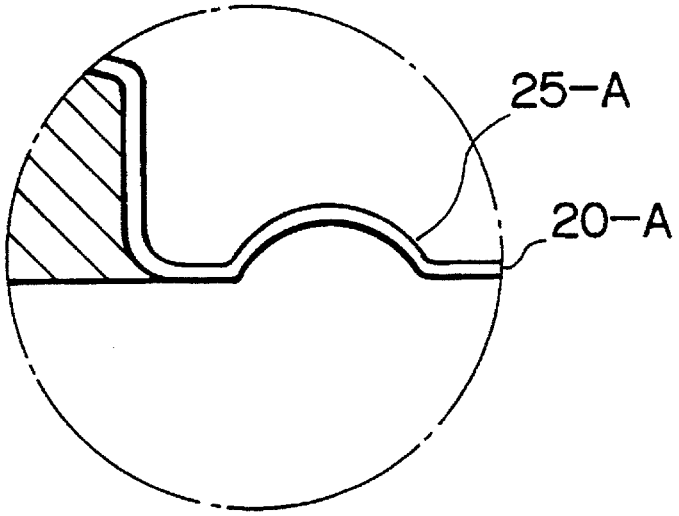
FIGS. 9(A) and 9(B) are diagrams illustrating other structures of curved projections used in the present invention.
Figure 9:
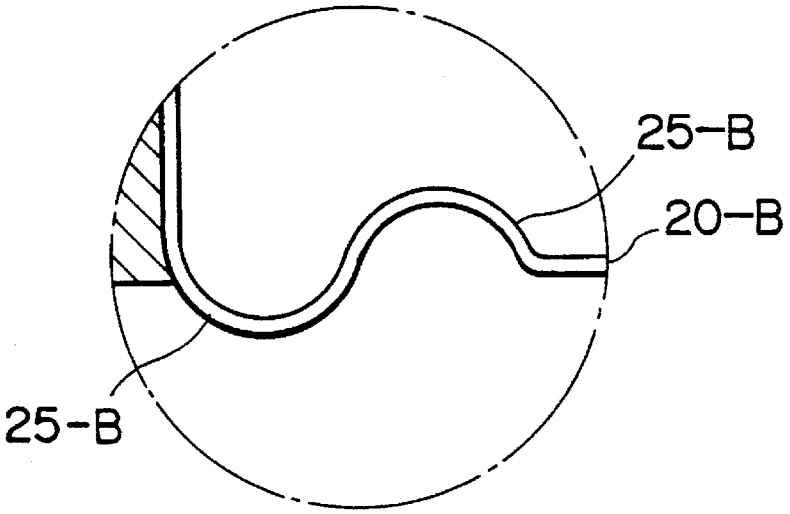

In the first through fifth embodiments described above, the curved projection protrudes downward from the surface of a film sheet. However, as shown in FIG. 9(A), a curved projection 25-A may be formed so as to protrude upward from the surface of a film sheet 20-A, or, as shown in FIG. 9(B), curved projections 25-B may be formed so as to protrude upward and downward in the manner of a wave relative to the surface of a film sheet 20-B. In the latter case, the greater the length of the curved projections 25-B in comparison with the other embodiments, the easier it is to press the keytop.

Figure 10:
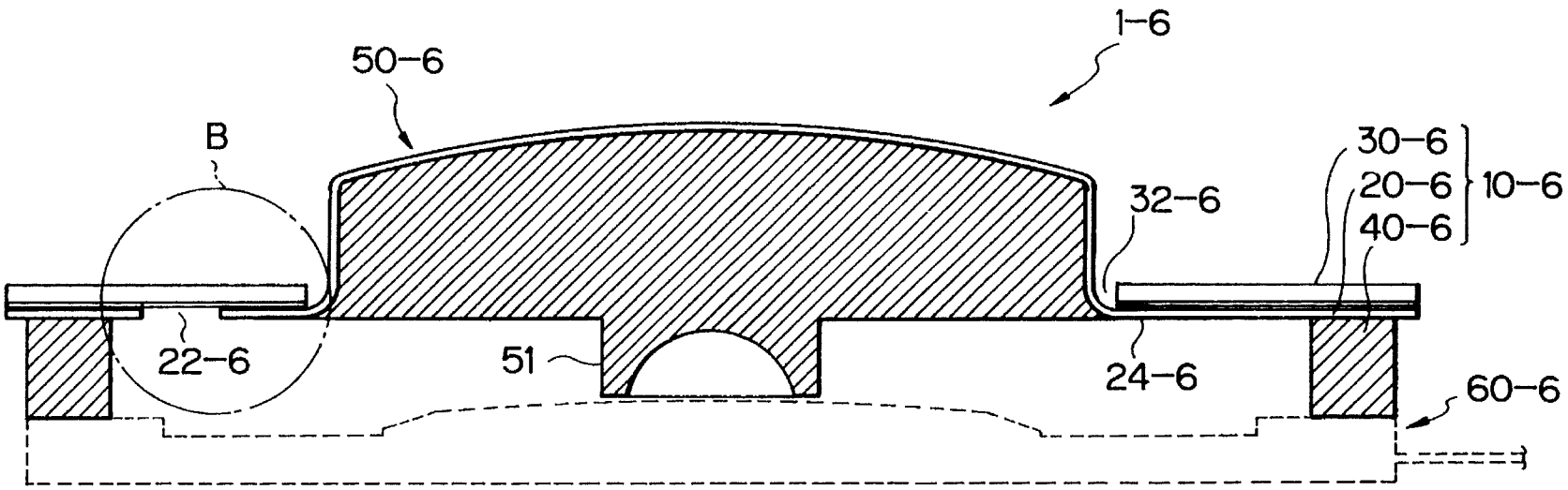
FIG. 10 is a sectional view of a push-button switch one component of which is a sixth embodiment of a keytop sheet according to the present invention.

FIG. 10 illustrates a push-button switch 1-6 one component of which is a sixth embodiment of a keytop sheet 10-6 according to the present invention. As shown in FIG. 10, the push-button switch 1-6 includes a keytop sheet 10-6, in which a nameplate 30-6 and a frame 40-6 are secured above and below a film sheet 20-6 provided with a keytop 50-6. A switch substrate 60-6 (only the outline of which is shown) is the same as the switch substrate 60 depicted in FIG. 1.

Figure 12:
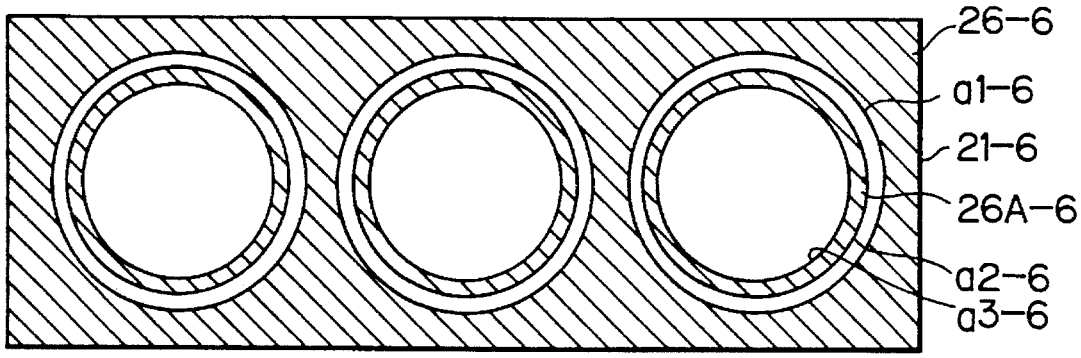
FIGS. 12(A), 12(B) and 12(C) are plan view illustrating a procedure for manufacturing a film sheet.
Figure 12:
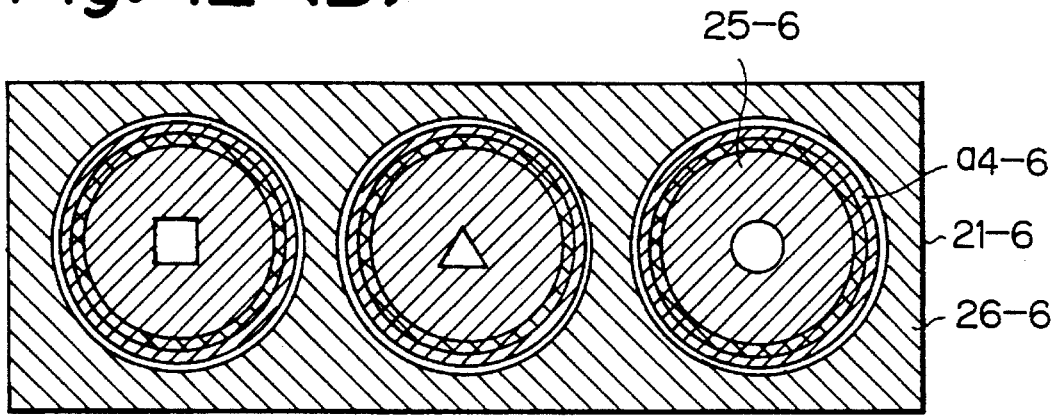
Figure 12:
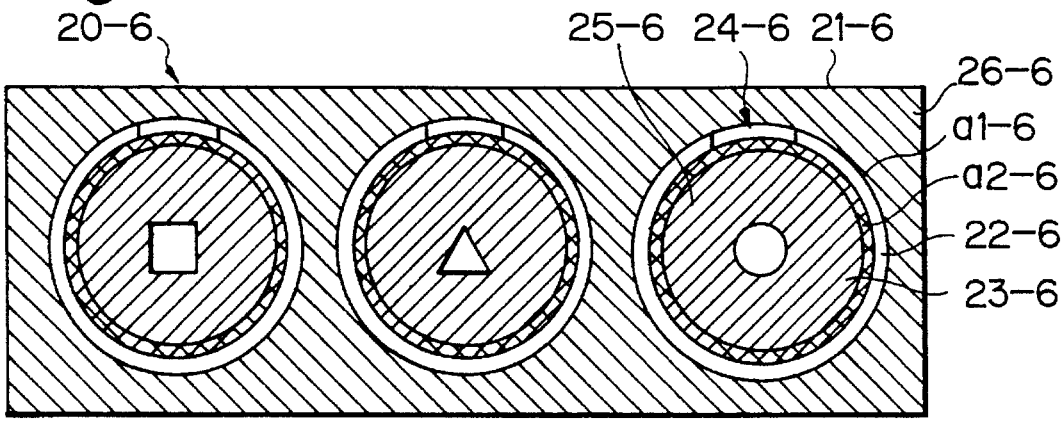
Figure 13:
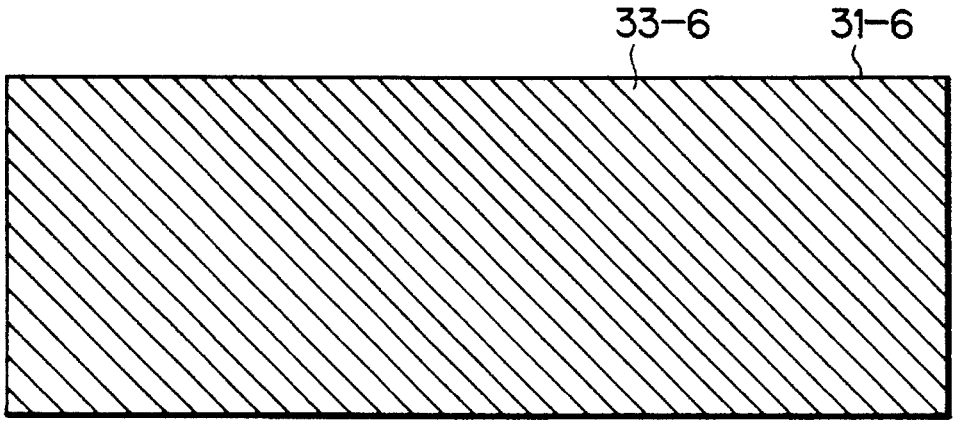
FIGS. 13(A), 13(B), 13(C) are plan views illustrating a procedure for manufacturing a nameplate.
Figure 13:
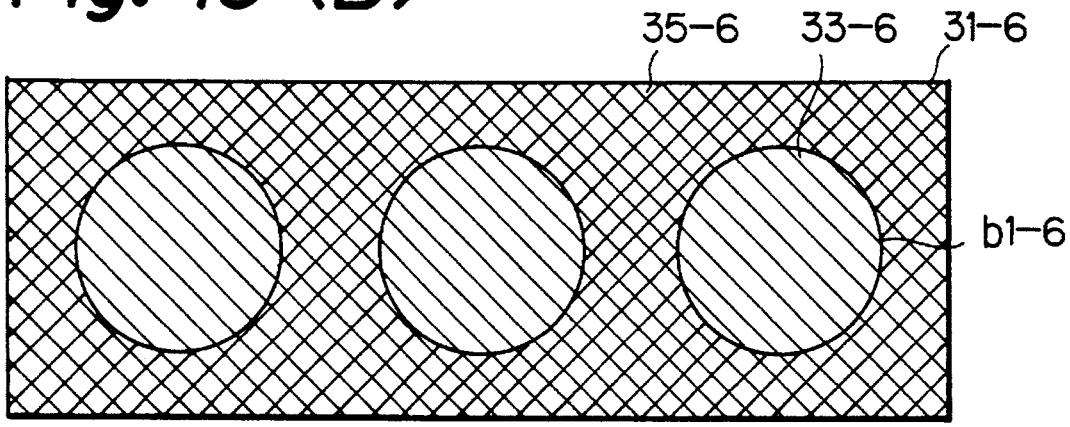
Figure 13:
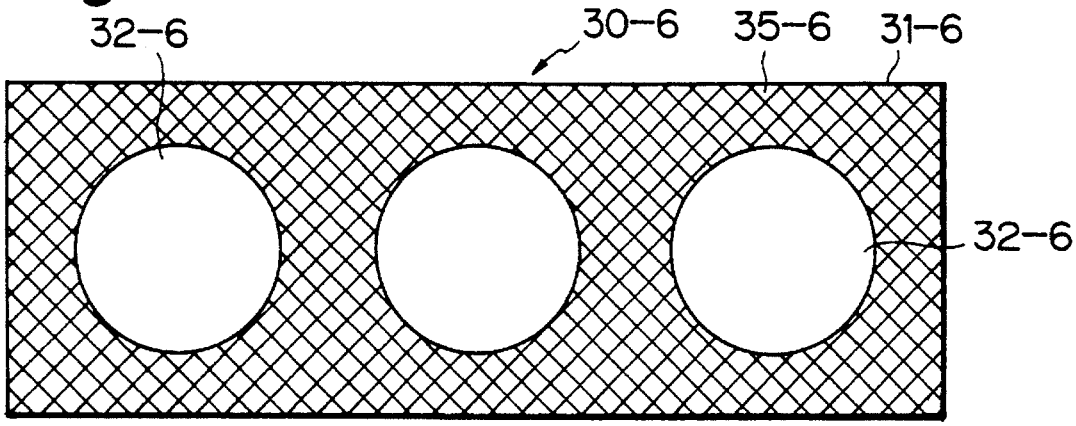

FIGS. 11(A) and 11(B) are diagrams illustrating the keytop sheet 10-6 of FIG. 10, in which FIG. 11(A) is a plan view and FIG. 11(B) a side view. FIGS. 12(A), 12(B), 12(C) are plan views illustrating a procedure for manufacturing the film sheet 20-6, and FIGS. 13(A), 13(B), 13(C) are bottom views illustrating a procedure for manufacturing the nameplate 30-6.

In order to manufacture the film sheet 20-6, first a thermoplastic synthetic resin 21-6 (e.g., polyethylene terephthalate, polyethylene naphthalate, etc.) is prepared, as shown in FIG. 12(A), and a bonding agent 26-6 such as epoxy resin or urethane resin is printed on the top of the film 21-6 to a thickness of 25~30 μm.

The bonding agent 26-6 is applied to the entirety of the film 21-6 with the exception of the interior of a circle a1-6, and to a ring-shaped portion 26A-6 located within the circle a1-6. The ring-shaped portion 26A-6 is a portion between two circles a2-6 and a3-6.

Next, as shown in FIG. 12(B), decorative printing 25-6 comprising a desired design or the like is applied to a prescribed position of the film 21-6. The decorative printing 25-6 is applied inwardly of a circle a4-6 between the circle a1-6 and the circle a2-6 illustrated in FIG. 12(A). It should be noted that the thickness of the decorative printing 25-6 is on the order of 5~7 μm.

Next, as shown in FIG. 12(C), the portion between the circles a1-6 and a2-6 of the film 21-6 is cut away to provide a C-shaped cut-out 22-6. As a result, a structure is obtained in which a circular keytop portion 23-6 is connected to the film 21-6 solely by a hinge portion 24-6 of a small width.

In order to manufacture the nameplate 30-6, first a synthetic resin film 31-6 (e.g., polyethylene terephthalate or the like; a thermoplastic resin need not necessarily be used) is prepared and printing 33-6 such as a desired design is applied over the entire underside of the film 31-6, as illustrated in FIG. 13(A).

Next, as shown in FIG. 13(B), a bonding agent 35-6 such as epoxy resin or urethane resin is printed on the printing 33-6. It should be noted that the bonding agent 35-6 is not printed inwardly of a circle b1-6. The diameter of the circle b1-6 is the same as that of the circle a3-6 shown in FIG. 12(A).

The portion of the film 31-6 on which the bonding agent 35-6 has net been printed is cut away, as shown in FIG. 13(C), thereby providing a circular hole 32-6. The diameter of the hole 32-6 is the same as the diameter of the circle b1-6.

The nameplate 30-6 shown in FIG. 13(C) is placed upon the film sheet 20-6 of FIG. 12(C) in such a manner that the two layers of bonding agents 26-6, 35-6 contact each other. The nameplate 30-6 and film sheet 20-6 are bonded strongly together by thermocompression bonding.

Next, the keytop 50-6 and frame 40-6 are provided simultaneously, by resin molding, on the unitary body comprising the film sheet 20-6 and nameplate 30-6. This method will now be described with reference to FIG. 14.

Figure 14:
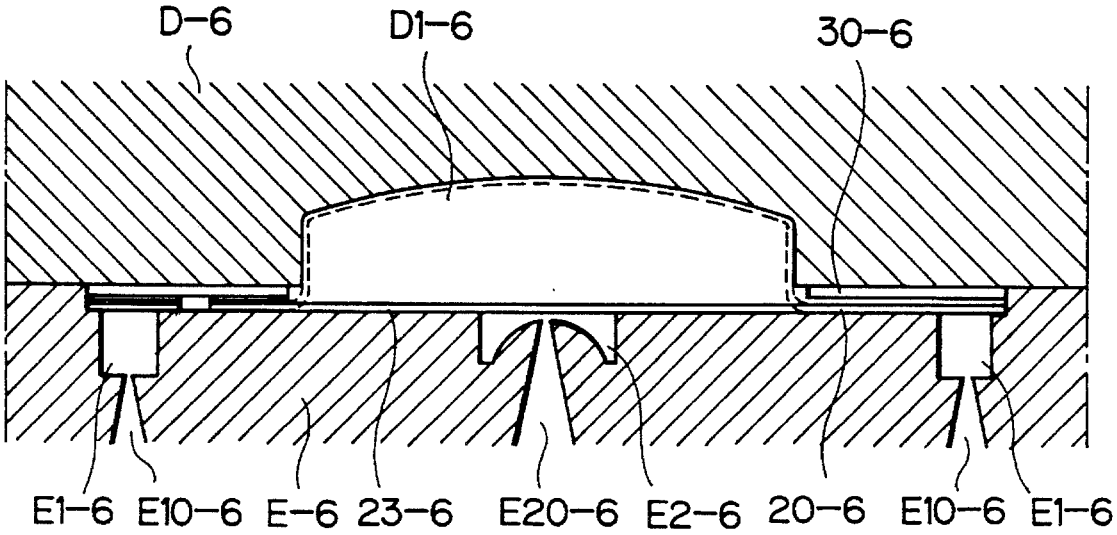
FIG. 14 is a diagram illustrating a method of forming the keytop sheet of the switch shown in FIG. 10 by resin molding.

As shown in FIG. 14, the film sheet 20-6 and nameplate 30-6 united in the manner set forth above are clamped between an upper mold D-6 and a lower mold E-6. The upper mold D-6 is provided with a cavity D1-6 for forming the keytop 50-6, and the lower mold E-6 is provided with a cavity E1-6 for forming the frame 40-6 and a cavity E2-6 for forming a pushing portion 51-6 of the keytop 50-6. The cavities El-6, E2-6 of the lower mold E-6 are provided with pin gates E10-6, E20-6, respectively.

When a high-temperature, high-pressure molten resin is forcibly introduced from the pin gates E10-6, E20-6, a frame 40-6 is formed on the outer periphery of the underside of the film sheet 20-6, and the keytop portion 23-6 of the film sheet 20-6 is urged upwardly and deformed so as to adhere to the inner surface of the mold D-6 cavity D1-6, as indicated by the dashed line in FIG. 14. At the same time, the cavity D1-6 and the cavity E2-6 are filled with the molten resin.

Since the thermoplastic molten resin introduced at this time is at a high temperature and pressure and the film sheet 20-6 consists of thermoplastic resin, the forcibly introduced resin and film sheet 20-6 are directly and strongly fused together so that the film sheet 20 will not peel off. (It should be noted that an adhesive layer may be interposed between the resin and the film sheet, as described earlier in connection with the first embodiment.) In other words, the portion of the film sheet 20-6 having the keytop portion 23-6 is caused to protrude and deform upwardly, thereby forming a bulge having the shape of the inner surface of the mold D-6, and the synthetic resin is caused to fill the interior of the bulge and is allowed to harden so as to integrate the resin and the film sheet and form the keytop 50-6.

Figure 11:
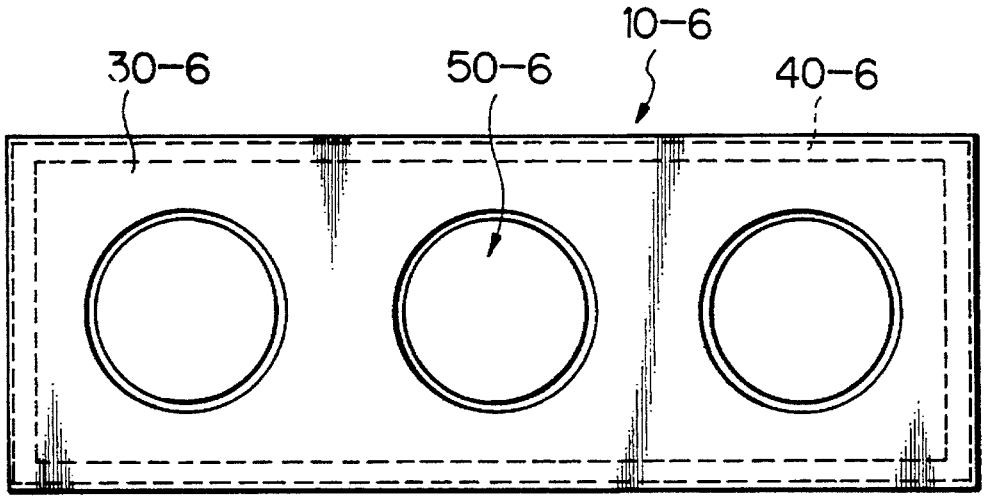
Figure 11:
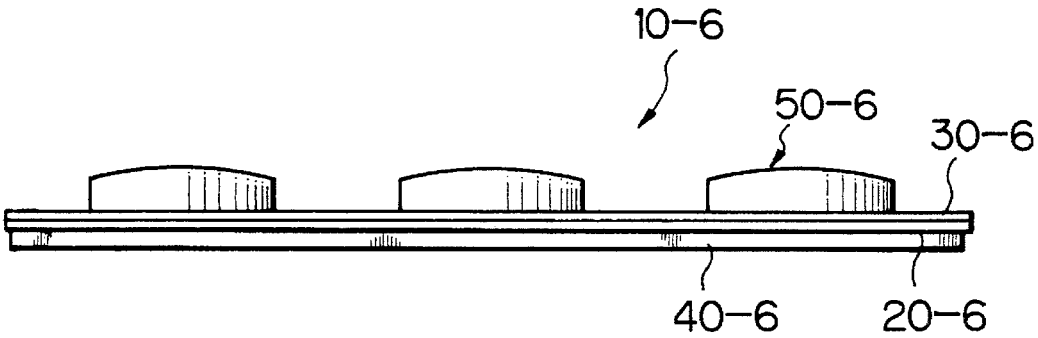

Separating the upper and lower molds D-6, E-6 completes the keytop sheet 10-6 shown in FIGS. 10 and 11.

As shown in FIGS. 10 and 11, the cut-out 22-6 [see FIG. 12(C)] provided in the film sheet 20-6 is concealed by being covered by the nameplate 30-6 and therefore cannot be seen from upper side. This makes it possible to maintain the attractive appearance of the keytop sheet 10-6.

Further, although the hinge portion 24-6 [see FIG. 12(C)] of the film sheet 20-6 develops a wrinkle when the keytop 50-6 is pressed, the hinge portion 24-6 also is covered and concealed by the nameplate 30-6 so that the attractive appearance of the keytop sheet is maintained in this sense as well.

Figure 15:
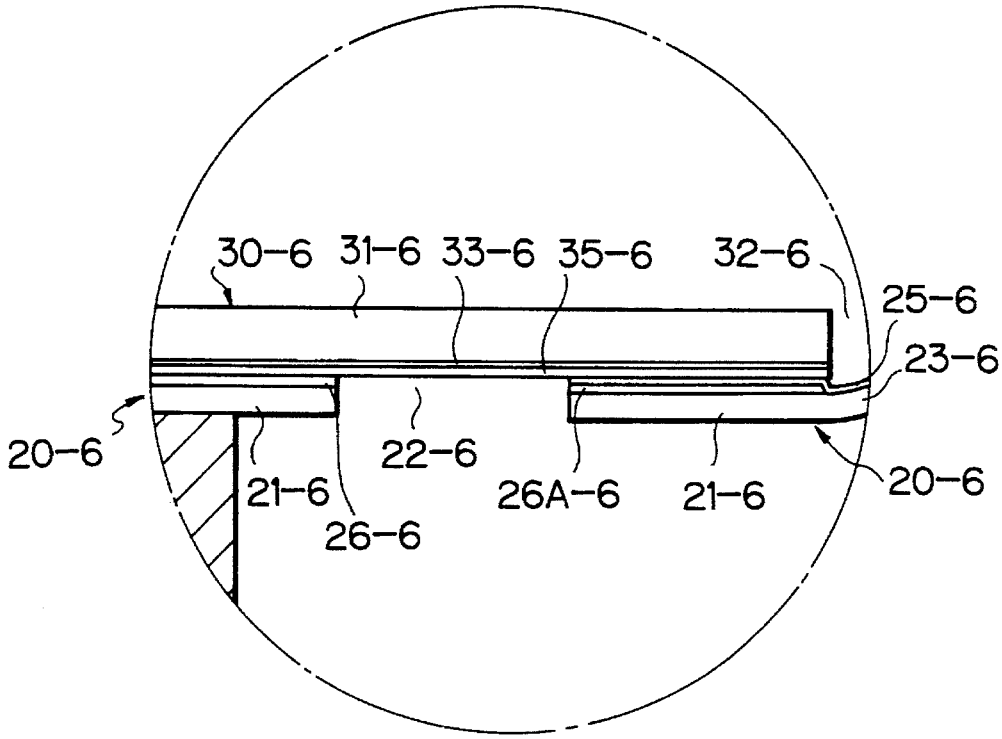
FIG. 15 is an enlarged view of an encircled portion B in FIG. 10.

FIG. 15 is an enlarged view of portion B in FIG. 10. As illustrated in FIG. 15, while the layer of bonding agent 26-6 of the film sheet 20-6 and the layer of bonding agent 35-6 of the nameplate 30-6 are in direct contact with each other, the two are bonded together by heat. However, since the decorative printing 25-6 has been applied to the ring-shaped portion 26A-6, the two are not bonded together at this portion even though heat is applied. In other words, the two members are merely in contact with each other at this portion.

This portion is provided with the ring-shaped portion 26A-6 for the following reason. If this portion were not provided with the ring-shaped portion 26A-6 comprising a bonding agent of a prescribed thickness, a gap would be produced between the bonding agent 35-6 of the nameplate 30-6 and the decorative printing 25-6 of the film sheet 20-6 at this portion. If this were then clamped between the molds D-6, E-6 shown in FIG. 14, the film sheet 20-6 of the ring-shaped portion 26A-6 and the nameplate 30-6 could not be clamped together strongly and fixedly secured. If this portion cannot be fixedly secured, the molten resin will flow out from the gap to the side of the cut-out 22-6 of the film sheet 20-6 when the molten resin is charged. Such a molding operation is unsatisfactory.

A particular characterizing feature of this embodiment is that the thickness of the portion where the film sheet 20-6 of the ring-shaped portion 26A-6 and the nameplate 30-6 overlap is equal to the sum of the thickness of the film 21-6, the thickness of the ring-shaped portion 26A-6, the thickness of the decorative printing 25-6, the thickness of the bonding agent 35-6, the thickness of the decorative printing 33-6 and the thickness of the film 31-6. By contrast, the thickness of the portion where the film sheet 20-6 and nameplate 30-6 overlap is equal to the sum of the thickness of the film 21-6, the thickness of the bonding agent 26-6, the thickness of the bonding agent 35-6, the thickness of the decorative printing 33-6 and the thickness of the film 31-6. In other words, the thickness of the portion where the film sheet 20-6 of the ring-shaped 26A-6 and the nameplate 30-6 overlap is greater than that of other portions by the thickness of the decorative printing 25-6. As a consequence, the clamping of this portion by the molds D-6, E-6 is strengthened and made more certain.

In the above-described embodiment, the film sheet 20-6 and the nameplate 30-6 are bonded together by a thermocompression bonding step. However, this step is not always necessary. The reason is that if the above-mentioned members are clamped between the upper and lower molds D-6, E-6 shown in FIG. 14 in a state in which the film sheet 20-6 and nameplate 30-6 are merely superimposed (i.e., without being bonded together by thermocompression) and the molten resin is forcibly introduced, the two layers of bonding agents 25-5, 35-6 are melted and bonded together by the pressure and heat of the molten resin and the temperature of the high-temperature molds D-6, E-6.

If the keytop sheet 10-6 is attached to the switch substrate 60-6 and the keytop 50-6 of the keytop sheet 10-6 is pressed, the pushing portion 51-6 presses the click spring of the switch substrate 60-6 and the switch contact, thereby closing the switch contact.

When the keytop 50-6 is pressed, the hinge portion 24-6 flexes since the film sheet 20-6 is provided with the cut-out 22-6 and the keytop 50-6 is merely connected to the film sheet 20-6 by the hinge portion 24-6. As a result, the keytop 50-6 is very easy to depress.

In the embodiment described above, the keytop 50-6 can be brightly illuminated from its lower side if the charged resin consists of a transparent material and a light-emitting element is disposed on the switch-substrate 60-6.

In the sixth embodiment described above, the hinge portion 24-6 is provided at only one location. However, the invention is not limited to such an arrangement; the hinge portion may be provided at a plurality of locations.

Figure 16:
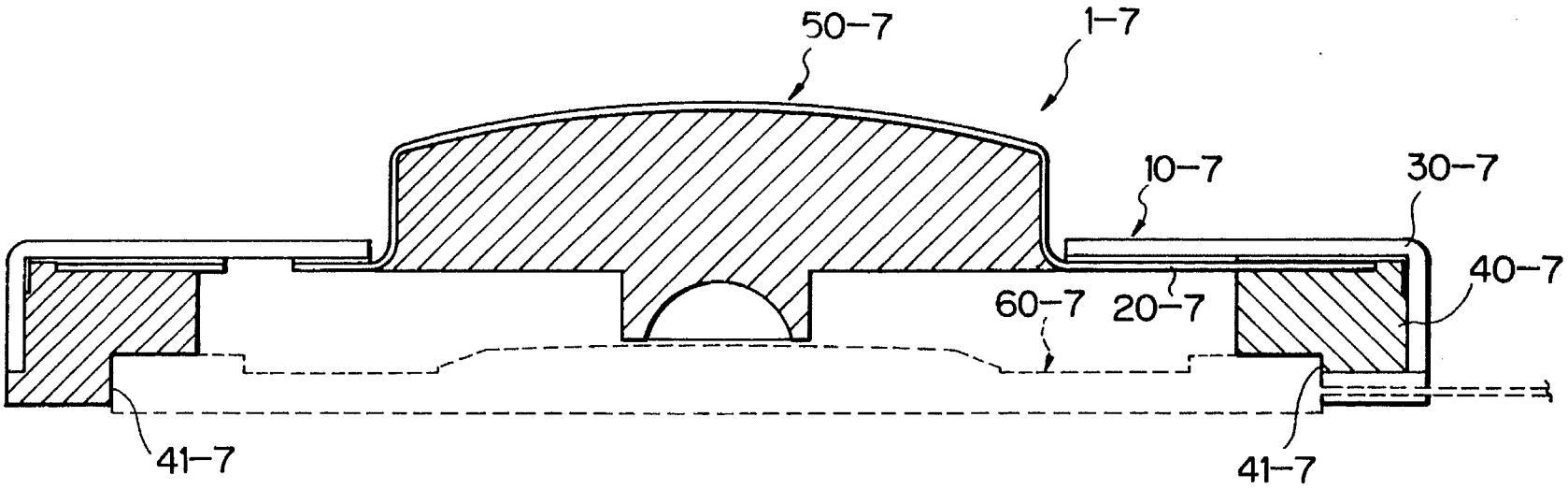
FIG. 16 is a sectional view of a push-button switch one component of which is a seventh embodiment of a keytop sheet according to the present invention.

FIG. 16 is a sectional view illustrating a push-button switch 1-7 one component of which is a seventh embodiment of a keytop sheet 10-7 according to a seventh embodiment of the present invention.

Although this embodiment has approximately the same structure as that of the sixth embodiment, it differs from the sixth embodiment in that a nameplate 30-7 has an outer dimension greater than that of a film sheet 20-7 by a predetermined amount, and the outer peripheral portion of the nameplate 30-7 that extends beyond the film sheet 20-7 is bent and secured to the side face of a frame 40-7.

Figure 17:
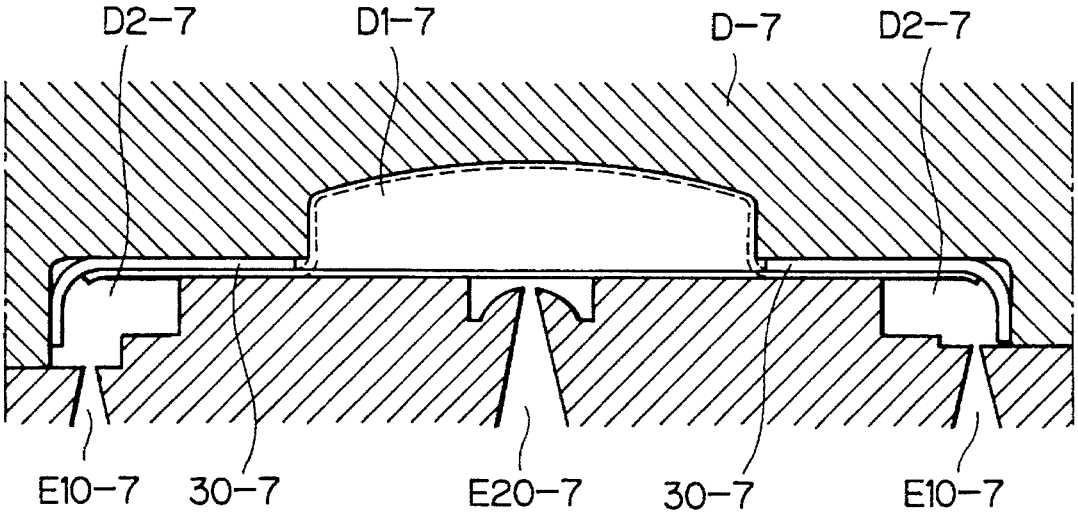
FIG. 17 is a diagram illustrating a method of forming the keytop sheet of FIG. 16 by resin molding.

FIG. 17 is a diagram illustrating a method of forming the keytop sheet 10-7 of FIG. 16 by resin molding.

According to this embodiment as shown in FIG. 17, an upper mold D-7 has an outer peripheral portion surrounding a cavity D1-7, and the outer peripheral portion extends downward to provide a second cavity D2-7. When molten resin is forcibly introduced from pin gates E10-7, E20-7, the outer peripheral portion of the nameplate 30-7 adheres to the outer peripheral side face of the second cavity D2-7.

The reason for adopting this configuration is as follows.

In the case of the push-button switch 1-6 according to the sixth embodiment shown in FIG. 10, an outer peripheral face f of the keytop sheet 10-6 is plate-shaped. As a result, when it is attempted to conceal the keytop sheet 10-6 by a case 80-6 for the sake of design and so that the film sheet 20-6 will not peel off the nameplate 30-6, it is necessary to make the surface of the top h of the push-button switch 1-6 lower than the top g of a side wall 81-6 of the case 80-6 when the push-button switch 1-6 is fitted into the case 80-6. Consequently, dust tends to accumulate at a stepped portion 83-6 produced by the two top surfaces g, h.

Owing to an error in the assembly of the push-button switch 1-6, some dimensional error develops in the thickness of the push-button switch 1-6. Owing to this error in the thickness direction, there is the danger that the surface h may exceed that of the surface g. This means that the assembly error in the thickness direction of the push-button switch 1-6 must be reduced. Accordingly, strict measurement must be taken to deal with assembly error in the thickness direction.

Figure 18:
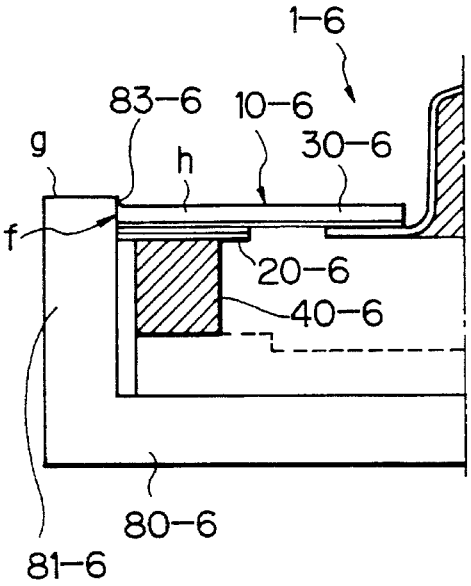
FIG. 18(A) is a schematic view of a principal portion of a push-button switch showing the state in which a push-button switch is accommodated in a case.
Figure 18:
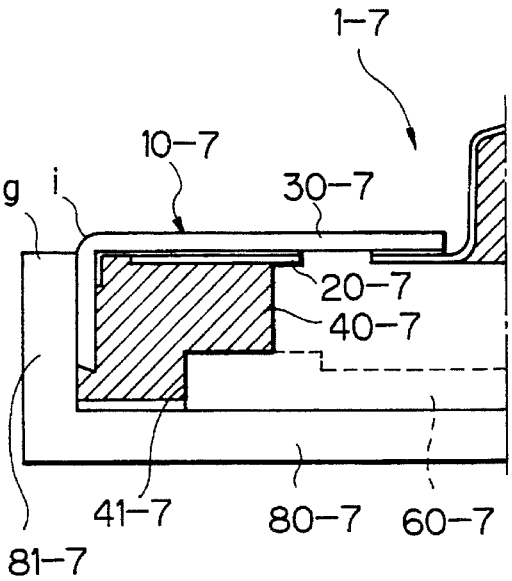

By contrast, in the case of a push-button switch 1-7 using the keytop sheet 10-7 according to the seventh embodiment, an upper edge i on the outer periphery of the keytop sheet 10-7 is covered by nameplate 30-7, as shown in FIG. 18(B). As a result, even if the upper edge i is caused to project somewhat from the top side g of a side wall 81-7 of a case 80-7, there is no problem in terms of design and there is no danger that the film sheet 20-7 will peel off the nameplate 30-7. Accordingly, no problems arise even if there is some dimensional error in the thickness of the push-button switch 1-7. This means that especially strict measures need not be taken to deal with assembly error in the thickness direction of the push-button switch 1-7. This facilitates operability and fabrication as well.

Further, since the underside of the frame 40-7 is provided with a stepped portion 41-7 in this embodiment, the outer peripheral portion of the switch substrate 60-7 need only be engaged with the stepped portion 41-7, thereby facilitating the positioning and fixing of the switch substrate.

Figure 19:
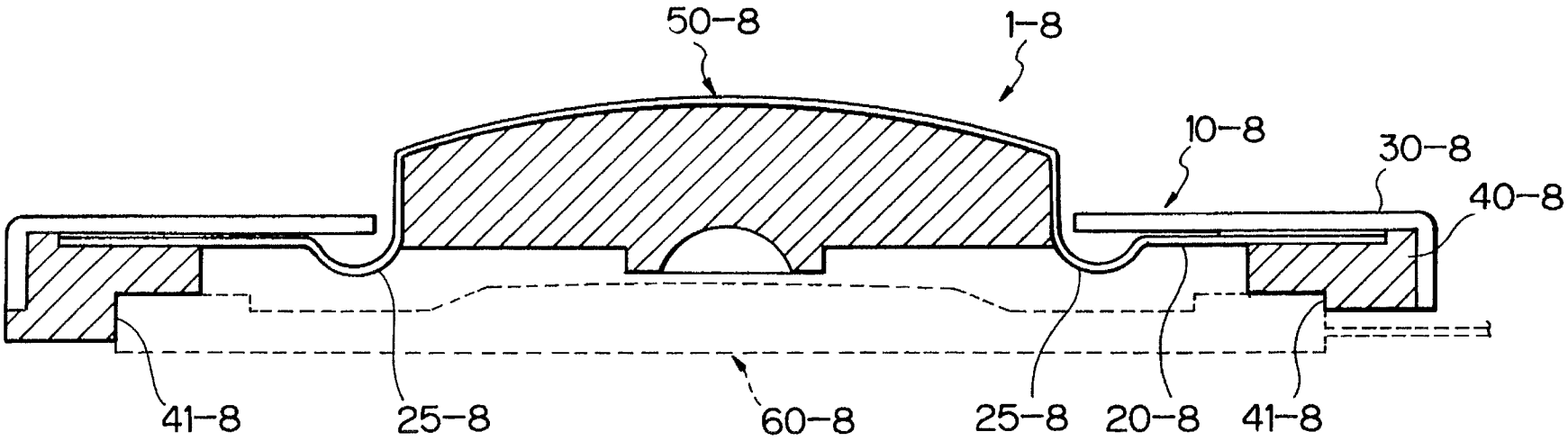
FIG. 19 is a sectional view of a push-button switch one component of which is an eighth embodiment of a keytop sheet according to the present invention.
Figures 20A, 20B:
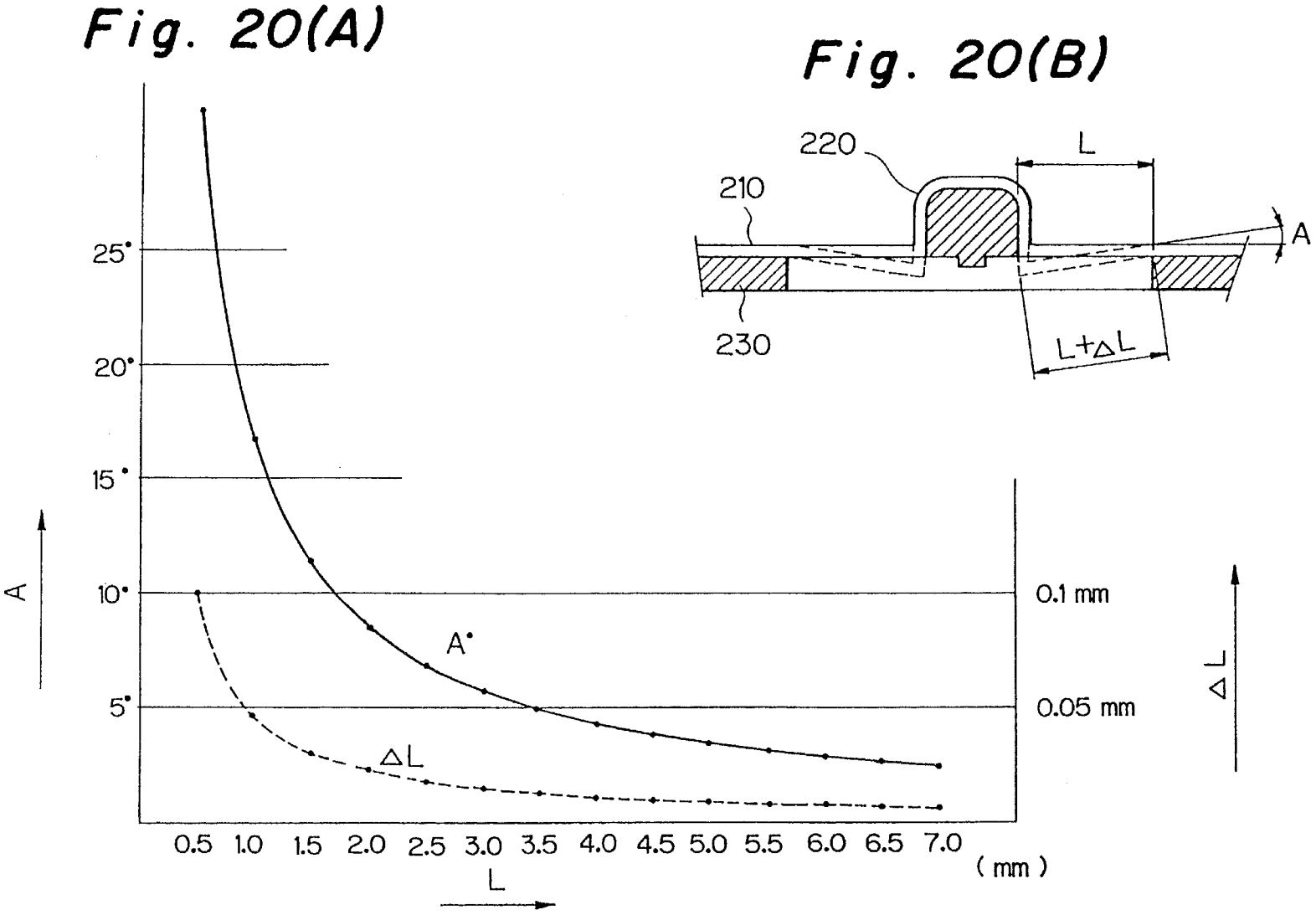
FIGS. 20(A) and 20(B) are diagrams together showing the relationship among an angle of inclination A of a film sheet, L and ΔL, where L represents the spacing between a keytop and a frame to which a film sheet has been affixed, and ΔL represents the amount by which the film sheet must stretch when the keytop is depressed by 0.3 mm.

FIG. 19 is a sectional view illustrating a push-button switch 1-8 one component of which is an eight embodiment of a keytop sheet 10-8 according to an eighth embodiment of the present invention. The keytop sheet 10-8 includes a film sheet 20-8 the center of which is provided with a keytop 50-8. A frame 40-8 is attached to the outer periphery of the underside of the film sheet 20-8, and the portion of the film sheet 20-8 surrounding the keytop 50-8 is provided with a downwardly protruding curved projection 25-8. Further, a nameplate 30-8 is affixed to the top of the film sheet 20-8. In these respects the structure is the same as that of the keytop sheet 10-2 shown in FIG. 5. In addition, a portion of the nameplate 30-8 that projects beyond the film sheet 20-8 is bent and fixed to the side face of the frame 40-8, and a stepped portion 41-8 is provided on the underside of the frame 40-8. In these respects the structure is the same as that of the seventh embodiment illustrated in FIG. 16. The effects of this embodiment are a combination of the effects of the arrangements shown in FIGS. 5 and 16.

As many apparently widely different embodiments of the present invention can be made without departing from the spirit and scope thereof, it is to be understood that the invention is not limited to the specific embodiments thereof except as defined in the appended claims.

What is claimed is:

1. A keytop sheet for use in a push-button switch, said keytop sheet comprising: a resin film sheet having a keytop portion, a hinge portion which is contiguous to said keytop portion, and a cutout formed through said resin film sheet from an upper side to a lower side thereof, said cutout extending around said keytop portion and terminating at ends between which said hinge portion is formed such that said keytop portion of the film sheet is connected to the remainder of the film sheet by said hinge portion; a keytop molded to said keytop portion of said film sheet, said keytop having a pushing portion at the bottom thereof for use in engaging a contact of the push-button switch; and a nameplate comprising a sheet of resin attached to said resin film sheet, said nameplate having a hole therein through which said keytop protrudes, and said nameplate covering said hinge portion and said cutout of the resin film sheet.

2. A keytop sheet for use in a push-button switch as claimed in claim 1, and further comprising a bonding agent located outwardly of the cutout on the upper side of said resin film sheet and also at an outer part of said keytop portion on the upper side of said resin film sheet, and decorative printing located on that portion of said bonding agent located at the outer part of said keytop portion, said nameplate being secured to said resin film sheet by that portion of said bonding agent that is located outwardly of the cutout.

* * * * *